US010794197B2

(12) United States Patent
Margolies et al.

(10) Patent No.: US 10,794,197 B2
(45) Date of Patent: Oct. 6, 2020

(54) COATED TURBINE COMPONENT AND METHOD FOR FORMING A COMPONENT

(71) Applicant: GENERAL ELECTRIC COMPANY, Schenectady, NY (US)

(72) Inventors: Joshua Lee Margolies, Niskayuna, NY (US); Victor John Morgan, Simpsonville, SC (US); Matthew Troy Hafner, Honea Path, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 595 days.

(21) Appl. No.: 15/623,842

(22) Filed: Jun. 15, 2017

(65) Prior Publication Data

US 2018/0363478 A1 Dec. 20, 2018

(51) Int. Cl.

| | |
|---|---|
| ***F01D 5/28*** | (2006.01) |
| ***F01D 25/24*** | (2006.01) |
| ***F01D 9/02*** | (2006.01) |
| ***F23R 3/00*** | (2006.01) |
| ***F01D 25/00*** | (2006.01) |

(52) U.S. Cl.

CPC ..... *F01D 5/288* (2013.01); *F01D 9/02* (2013.01); *F01D 25/005* (2013.01); *F01D 25/007* (2013.01); *F01D 25/24* (2013.01); *F23R 3/002* (2013.01); *F23R 3/007* (2013.01); *F01D 9/023* (2013.01); *F05D 2240/11* (2013.01); *F05D 2240/122* (2013.01); *F05D 2240/304* (2013.01); *F05D 2240/35* (2013.01); *F05D 2240/80* (2013.01); *F05D 2250/292* (2013.01); *F05D 2300/175* (2013.01); *F05D 2300/6033* (2013.01); *F05D 2300/611* (2013.01)

(58) Field of Classification Search

CPC ..... F01D 5/288; F01D 25/005
USPC ..... 427/402
See application file for complete search history.

(56) References Cited

U.S. PATENT DOCUMENTS

| | | | | |
|---|---|---|---|---|
| 6,234,755 | B1 * | 5/2001 | Bunker | F01D 5/186 416/97 R |
| 8,533,949 | B2 * | 9/2013 | Bunker | F01D 5/147 29/889.7 |
| 8,876,481 | B2 | 11/2014 | Huang et al. | |
| 9,221,720 | B2 | 12/2015 | Tulyani et al. | |
| 9,364,935 | B2 | 6/2016 | Fuller | |
| 9,404,185 | B2 | 8/2016 | Bouillon et al. | |
| 9,409,206 | B2 | 8/2016 | Berry et al. | |
| 9,476,306 | B2 * | 10/2016 | Bunker | F01D 5/187 |

(Continued)

OTHER PUBLICATIONS

R. C. Tucker, Jr., Introduction to Coating Design and Processing, ASM Handbook, vol. 5A, Thermal Spray Technology, http://www.asmintemational.org/documents/10192/1849770/Z05348L_Sample_eBook.pdf/d407426d-a8d1-47b9-a568-8d7fcbbcea1a.

*Primary Examiner* — Ninh H. Nguyen
*Assistant Examiner* — Aye S Htay
(74) *Attorney, Agent, or Firm* — McNees Wallace & Nurick LLC

(57) ABSTRACT

A method for forming a coated turbine component and a coated turbine component is provided. The method includes a step of providing a component having a substrate including a trailing edge face. The method further includes a step of applying a thermal barrier coating or environmental barrier coating selectively to the substrate to form a discontinuous transition from a hot gas path surface at the trailing edge face to discourage hot gas flow along the trailing edge face.

20 Claims, 2 Drawing Sheets

(56) References Cited

U.S. PATENT DOCUMENTS

| | | | | |
|---|---|---|---|---|
| 9,481,448 | B2 | 11/2016 | Totten et al. | |
| 2008/0232971 | A1* | 9/2008 | Ahmad | F01D 5/188 416/233 |
| 2015/0017018 | A1* | 1/2015 | Lacy | F01D 5/288 416/97 R |
| 2015/0352673 | A1 | 12/2015 | Kamel et al. | |

* cited by examiner

COATED TURBINE COMPONENT AND METHOD FOR FORMING A COMPONENT

FIELD OF THE INVENTION

The present invention is generally directed to a coated turbine component and a method for forming a coated turbine component. More specifically, the present invention is directed to a coated turbine component comprising a discontinuous transition and a method for forming a coated turbine component comprising a discontinuous transition.

BACKGROUND OF THE INVENTION

Certain components such as ceramic matrix composite (CMC) components for a gas turbine operate at high temperatures and pressures. In particular, recession, off-gassing of silicon hydroxides in the presence of water vapor at high temperatures and pressures, can occur at temperatures above 1500° F. Thus, environmental barrier coatings (EBC) are required in the hot combustion product environment of gas turbines. The need for the coating to be used in a stable, crystalline state requires heat treatment to produce the necessary crystalline state.

Known hot gas path components have sharp edged features that EBC/TBC will not adhere to. Alternatively, aerodynamic features such as blade squealer tips and flow separating step features that require tighter radii that create undesirable stresses in the coating as well, leading to the fatal failure of EBC/TBC.

BRIEF DESCRIPTION OF THE INVENTION

In an exemplary embodiment, a coated turbine component is provided. The coated turbine component comprises a substrate having a hot gas path surface and a curved trailing edge face. The coated turbine component further comprises a coating disposed on the hot as path surface and the curved trailing edge face and a discontinuous transition feature configured to discourage hot gas flow along the hot gas path surface from following along the curved trailing edge face, wherein the discontinuous transition feature is formed from an additional portion of the coating extending outward from the coating over a portion of the curved trailing edge face, and wherein the coating is a thermal barrier coating or an environmental barrier coating. In a further exemplary embodiment, the discontinuous transition feature may be disposed where the hot gas path surface and the curved trailing edge face meet.

In another exemplary embodiment, a method for forming a coated turbine component is provided. The method includes providing a component having a substrate comprising a hot gas path surface and a curved trailing edge face. The method further includes applying a coating to the hot gas path surface and the curved trailing edge face and forming a discontinuous transition feature extending outward from the coating over a portion of the curved trailing edge face by applying an additional portion of the coating to the substrate, wherein the discontinuous transition feature is configured to discourage hot gas flow along the hot gas path surface from flowing along the curved trailing edge face and wherein the coating is a thermal barrier coating or an environmental barrier coating.

Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided are exemplary methods and coated ceramic matrix composite components. Embodiments of the present disclosure, in comparison to methods and coated ceramic matrix composite components not utilizing one or more features disclosed herein, provide a discontinuous transition, directly using coating, from a hot gas path surface at the trailing edge face to discourage hot gas flow along the trailing edge face without a tight radius and unacceptable defects, thereby enabling a tighter leakage control in the case of blade squealer tips, a re-dimension of serviced components by thickening its barrier coating, and a retrofit of ceramic components as an uprate into a metal based design without debiting the life of the remaining metal components.

Figure 1:
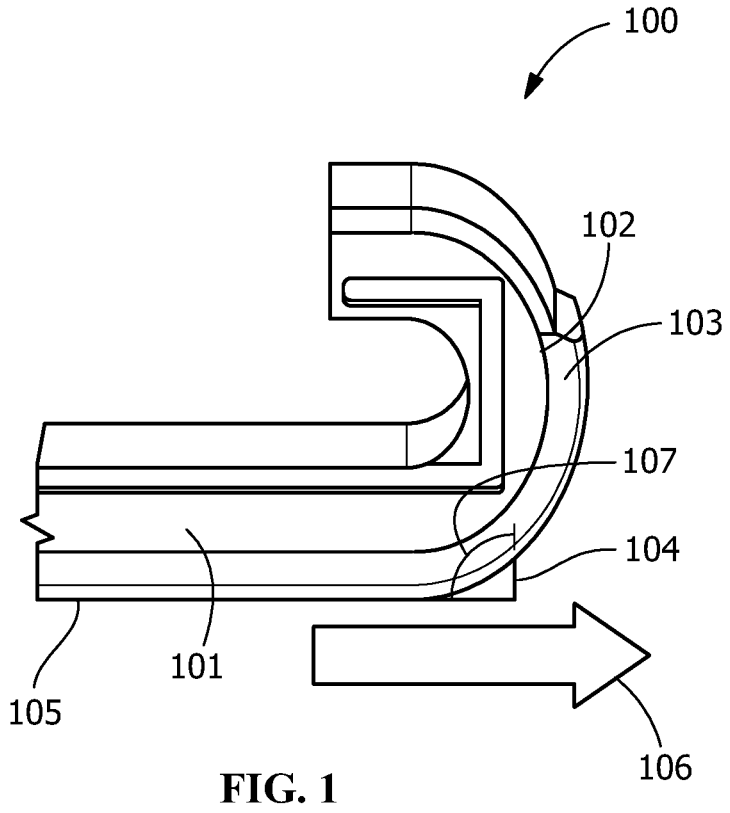
FIG. 1 illustrates a perspective view of a coated turbine component, according to the present disclosure.

With reference to FIG. 1, a coated turbine component 100 according to the present disclosure is provided. Coated turbine component 100 includes a substrate 101 comprising a trailing edge face 102 and a coating 103 selectively applied to substrate 101 to form a discontinuous transition 104 from a hot gas path surface 105 at trailing edge face 102 to discourage a hot gas flow 106 along trailing edge face 102. Substrate 101 does not include sharp edged features along trailing edge face 102. Coating 103 may include, for example, an environmental barrier coating or a thermal barrier coating.

Figure 2:
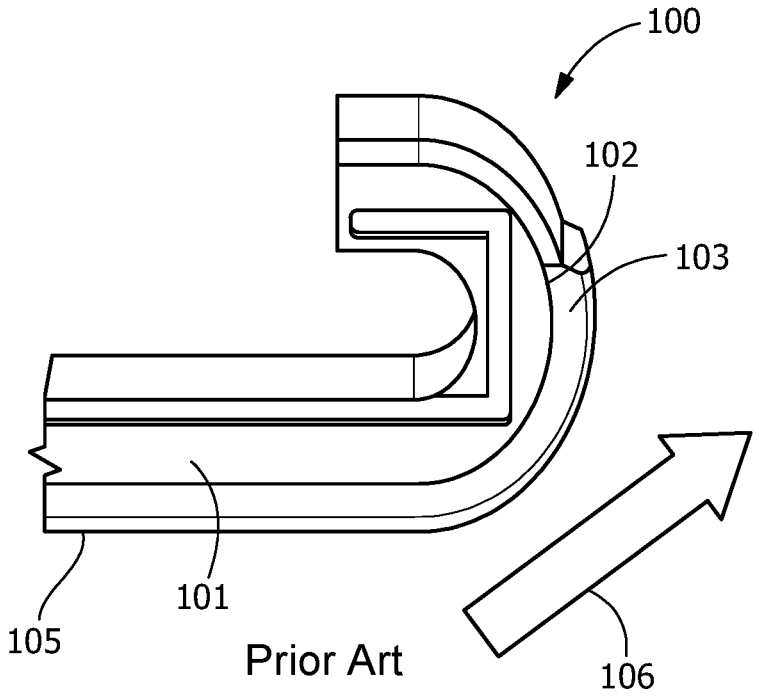
FIG. 2 illustrates a perspective view of a known coated turbine component.

With reference to FIG. 2, known systems without a discontinuous transition cannot discourage hot gas flow along the trailing edge face. The hot gas flow along the trailing edge face undesirably impinges on opposing or adjacent turbine components. Thus, in order to discourage hot gas flow along the trailing edge surface, a tighter radius of curvature has been tried, but undesirable stresses have been discovered in the coating when coated with EBC and heat treated during service. Also, it has surprisingly been discovered that a trailing edge face including an angled or sharp corner along the face evolves stresses in the coating when coated with EBC and heat treated during service.

Overcoming the aforementioned failures, the invention provides a novel defect-free coated turbine component having a curved trailing edge face and a discontinuous transition made of a thermal barrier coating or an environmental barrier coating selectively applied to a substrate. The term "curved", as used herein, means a continuously bending line without angles.

In one embodiment, trailing edge face 102 may have a radius of 60-100 mils, 70-90 mils, or 80 mils, including increments, intervals, and sub-range therein. In another embodiment, trailing edge face 102 may have a minimum radius of 60 mils.

In one embodiment, coating 103 may have a thickness of 10-200 mils, 20-190 mils, 30-180 mils, 40-170 mils, 50-160 mils, 60-150 mils, 70-140 mils, 80-130 mils, 90-120 mils or 100-110 mils, including increments, intervals, and sub-range therein.

In one embodiment, coated turbine component 100 is selected from the group consisting of shrouds, nozzles, blades, combustors, combustor liners, combustor tiles and combinations thereof. A person skilled in the art will appreciate that any suitable coated turbine components are envisaged.

In one embodiment, discontinuous transition 104 forms a sharp feature.

In one embodiment, discontinuous transition 104 has an angle 107 of 75-105 degrees, 80-100 degrees, 85-95 degrees, or 90 degrees with respect to the hot gas path surface 105, including increments, intervals, and sub-range therein. The angle 107, as used herein, is defined an angle between a plane oriented along the hot gas path surface 105 and a plane oriented along the discontinuous transition 104.

In one embodiment, substrate 101 comprises a metallic material selected from the group consisting of a nickel superalloy, a cobalt superalloy, an iron superalloy, and combinations thereof. A person skilled in the art will appreciate that any suitable metallic materials are envisaged.

In one embodiment, substrate 101 comprises a ceramic matrix composite material selected from the group consisting of carbon-fiber-reinforced silicon carbide (C/SiC), silicon-carbide-fiber-reinforced silicon carbide (SiC/SiC), carbon-fiber-reinforced silicon nitride ($C/Si_3N_4$), silicon nitride-silicon carbide composite ($Si_3N_4/SiC$), alumina-fiber-reinforced alumina ($Al_2O_3/Al_2O_3$), and combinations thereof. A person skilled in the art will appreciate that any suitable ceramic matrix composite materials are envisaged.

In one embodiment, coating 103 comprises a bond coat and a top coat. In another embodiment, coating 103 consists of a bond coat and a top coat. In another embodiment, coating 103 comprises a bond coat and multiple top coats. In another embodiment, coating 103 consists of a bond coat and multiple top coats. In another embodiment, coating 103 comprises multiple bond coats and a top coat. In another embodiment, coating 103 consists of multiple bond coats and a top coat. In another embodiment, coating 103 comprises multiple bond coats and multiple top coats. In another embodiment, coating 103 consists of multiple bond coats and multiple top coats. In another embodiment, coating 103 comprises at least one bond coat, at least one thermally grown oxide layer and at least one top coat. In another embodiment, coating 103 consists of at least one bond coat, at least one thermally grown oxide layer and at least one top coat.

In one embodiment, suitable bond coat comprises a material selected from the group consisting of silicon, silicon-based alloy, silicon-based composite, silicon dioxide, MCrAlY and combinations thereof wherein M is Ni, Co, Fe, or mixtures thereof. A person skilled in the art will appreciate that any suitable bond coat materials are envisaged.

In one embodiment, coating 103 further comprises a transition layer comprising a material selected from the group consisting of barium strontium alumino silicate (BSAS), mullite, yttria-stabilized zirconia, $(Yb,Y)_2Si_2O_7$, rare earth monosilicates and disilicates and combinations thereof. A person skilled in the art will appreciate that any suitable TBC or EBC materials are envisaged.

In one embodiment, suitable top coats may comprise a material selected from the group consisting of $Y_2SiO_5$, barium strontium alumino silicate (BSAS), yttria-stabilized zirconia, yttria-stabilized hafnia, yttria-stabilized zirconia with additions of one or more rare earth oxides, yttria-stabilized hafnia with additions of one or more rare earth oxides and combinations thereof. A person skilled in the art will appreciate that any suitable top coat materials are envisaged.

Figure 3:
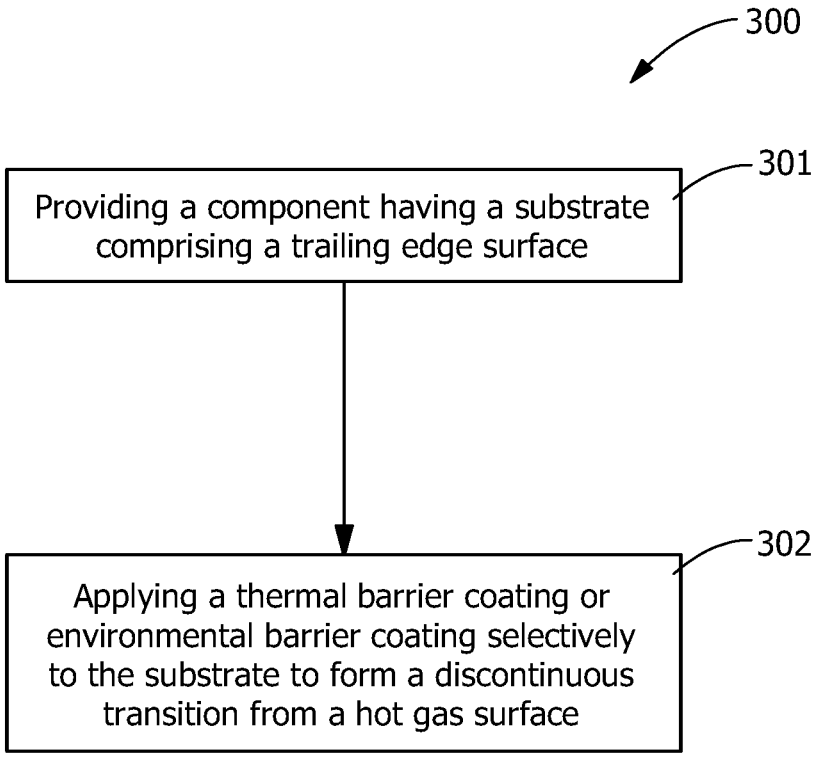
FIG. 3 illustrates a flow diagram of a method for forming a coated turbine component.

With reference to FIG. 3, a method 300 for forming a coated turbine component 100 is provided. The method includes a step of providing a component 100 having a substrate 101 comprising a trailing edge face 102 (step 301). The method further includes a step of applying a thermal barrier coating or environmental barrier coating 103 selectively to substrate 101 to form a discontinuous transition 104 from a hot gas path surface 105 at trailing edge face 102 to discourage a hot gas flow 106 along the trailing edge face (step 302).

In one embodiment, step 302 of applying the thermal barrier coating or environmental barrier coating 103 comprises at least one of physical vapor deposition, chemical vapor deposition, plasma-enhanced chemical vapor deposition, air plasma spray, vacuum plasma spray, combustion spraying with powder or rod, slurry coating, sol gel, dip coating, electrophoretic deposition, tape casting, and additive manufacturing techniques. Step 302 may further include a step of masking in close proximity to a targeted part and a step of thickening the coating locally on the targeted part.

In an embodiment, the method may further include a step of post-coating treatment including machining, grinding, grit-blasting or combinations thereof.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A coated turbine component, comprising:

a substrate comprising a hot gas path surface and a curved trailing edge face;

a coating disposed on the hot gas path surface and the curved trailing edge face; and a discontinuous transition feature configured to discourage hot gas flow along the hot gas path surface from flowing along the curved trailing edge face, wherein the discontinuous transition feature is formed from an additional portion of the coating extending outward from the coating over a portion of the curved trailing edge face, and wherein the coating is a thermal barrier coating or an environmental barrier coating.

2. The coated turbine component of claim 1, wherein the coated turbine component is selected from the group consisting of shrouds, nozzles, blades, combustors, combustor transition pieces, combustor liners, combustor tiles and combinations thereof.

3. The coated turbine component of claim 1, wherein the discontinuous transition feature is a sharp feature.

4. The coated turbine component of claim 3, wherein the discontinuous transition feature has an angle of 75-105 degrees with respect to the hot gas path surface.

5. The coated turbine component of claim 1, wherein the substrate comprises a metallic material selected from the group consisting of a nickel superalloy, a cobalt superalloy, an iron superalloy, and combinations thereof.

6. The coated turbine component of claim 1, wherein the substrate comprises a ceramic matrix composite material selected from the group consisting of carbon-fiber-reinforced silicon carbide (C/SiC), silicon-carbide-fiber-reinforced silicon carbide (SiC/SiC), carbon-fiber-reinforced silicon nitride ($C/Si_3N_4$), silicon nitride-silicon carbide composite ($Si_3N_4/SiC$), alumina-fiber-reinforced alumina ($Al_2O_3/Al_2O_3$), and combinations thereof.

7. The coated turbine component of claim 1, wherein the coating comprises a bond coat and one or multiple top coats.

8. The coated turbine component of claim 7, wherein the bond coat comprises a material selected from the group consisting of silicon, silicon-based alloy, silicon-based composite, silicon dioxide, MCrAlY and combinations thereof; wherein M is Ni, Co, Fe, or mixtures thereof.

9. The coated turbine component of claim 7, wherein the coating further comprises a transition layer comprising a material selected from the group consisting of barium strontium alumino silicate (BSAS), mullite, yttria-stabilized zirconia, $(Yb,Y)_2Si_2O_7$, rare earth monosilicates and disilicates and combinations thereof.

10. The coated turbine component of claim 7, wherein the top coat comprising a material selected from the group consisting of $Y_2SiO_5$, barium strontium alumino silicate (BSAS), yttria-stabilized zirconia, yttria-stabilized hafnia, yttria-stabilized zirconia with additions of one or more rare earth oxides, yttria-stabilized hafnia with additions of one or more rare earth oxides and combinations thereof.

11. A method for forming a coated turbine component, comprising:

providing a component having a substrate comprising a hot gas path surface and a curved trailing edge face;

applying a coating to the hot gas path surface and the curved trailing edge face; and forming a discontinuous transition feature extending outward from the coating over a portion of the curved trailing edge face by applying an additional portion of the coating to the substrate;

wherein the discontinuous transition feature is configured to discourage hot gas flow along the hot gas path surface from flowing along the curved trailing edge face, and wherein the coating is a thermal barrier coating or an environmental barrier coating.

12. The method of claim 11, wherein the step of applying the coating comprises at least one of physical vapor deposition, chemical vapor deposition, plasma-enhanced chemical vapor deposition, air plasma spray, vacuum plasma spray, combustion spraying with powder or rod, slurry coating, sol gel, dip coating, electrophoretic deposition, tape casting, and additive manufacturing techniques.

13. The method of claim 11, wherein the discontinuous transition feature is a sharp feature and has an angle of 90 degrees with respect to the hot gas path surface.

14. The method of claim 11, wherein the substrate comprises a metallic material selected from the group consisting of a nickel superalloy, a cobalt superalloy, an iron superalloy, and combinations thereof.

15. The method of claim 11, wherein the substrate comprises a ceramic matrix composite material selected from the group consisting of carbon-fiber-reinforced silicon carbide (C/SiC), silicon-carbide-fiber-reinforced silicon carbide (SiC/SiC), carbon-fiber-reinforced silicon nitride ($C/Si_3N_4$), silicon nitride-silicon carbide composite ($Si_3N_4/SiC$), alumina-fiber-reinforced alumina ($Al_2O_3/Al_2O_3$), and combinations thereof.

16. The method of claim 11, wherein the coating comprises a bond coat and one or multiple top coats.

17. The method of claim 16, wherein the bond coat comprises a material selected from the group consisting of silicon, silicon-based alloy, silicon-based composite, silicon dioxide, MCrAlY and combinations thereof; wherein M is Ni, Co, Fe, or mixtures thereof.

18. The method of claim 16, wherein the coating further comprises a transition layer comprising a material selected from the group consisting of barium strontium alumino silicate (BSAS), mullite, yttria-stabilized zirconia, $(Yb,Y)_2Si_2O_7$, rare earth monosilicates and disilicates and combinations thereof.

19. The method of claim 16, wherein the top coat comprises a material selected from the group consisting of $Y_2SiO_5$, barium strontium alumino silicate (BSAS), yttria-stabilized zirconia, yttria-stabilized hafnia, yttria-stabilized zirconia with additions of one or more rare earth oxides, yttria-stabilized hafnia with additions of one or more rare earth oxides and combinations thereof.

20. The coated turbine component of claim 1, wherein the discontinuous transition feature is disposed where the hot gas path surface and the curved trailing edge face meet.

* * * * *